US009010306B2

(12) United States Patent
Kawai et al.

(10) Patent No.: US 9,010,306 B2
(45) Date of Patent: Apr. 21, 2015

(54) IGNITION COIL FOR INTERNAL COMBUSTION ENGINES

(75) Inventors: Kazuhide Kawai, Kariya (JP); Katsunori Akimoto, Okazaki (JP); Gakuji Moriya, Wako (JP); Makoto Kurahashi, Wako (JP)

(73) Assignees: Denso Corporation, Kariya (JP); Honda Motor Co., Ltd., Tokyo (JP)

( * ) Notice: Subject to any disclaimer, the term of this patent is extended or adjusted under 35 U.S.C. 154(b) by 666 days.

(21) Appl. No.: 13/415,252

(22) Filed: Mar. 8, 2012

(65) Prior Publication Data

US 2012/0227715 A1 Sep. 13, 2012

(30) Foreign Application Priority Data

Mar. 8, 2011 (JP) ..... 2011-049988

(51) Int. Cl.
*H01F 38/12* (2006.01)
*F02P 3/02* (2006.01)
*H01F 27/02* (2006.01)

(52) U.S. Cl.
CPC ..... *F02P 3/02* (2013.01); *H01F 27/022* (2013.01); *H01F 38/12* (2013.01)

(58) Field of Classification Search
CPC ..... F02P 3/02; H01F 27/00; H01F 38/12
USPC ..... 123/143 C, 169 PA, 634, 635, 647; 336/90, 92, 96, 107, 196, 198
See application file for complete search history.

(56) References Cited

U.S. PATENT DOCUMENTS

| | | | | |
|---|---|---|---|---|
| 4,990,881 | A | 2/1991 | Ooyabu | |
| 5,628,298 | A * | 5/1997 | Murata | 123/635 |
| 5,870,012 | A * | 2/1999 | Sakamaki et al. | 336/107 |
| 6,005,464 | A * | 12/1999 | Sakamaki et al. | 336/96 |
| 6,427,674 | B1 * | 8/2002 | Wylin | 123/634 |
| 6,817,350 | B2 * | 11/2004 | Miwa et al. | 123/634 |
| 7,317,370 | B2 * | 1/2008 | Nakamoto et al. | 336/92 |
| 7,629,869 | B2 * | 12/2009 | Fujiyama | 336/90 |
| 7,646,277 | B2 * | 1/2010 | Tsunenaga et al. | 336/90 |
| 2011/0297133 | A1 * | 12/2011 | Nakao et al. | 123/635 |

FOREIGN PATENT DOCUMENTS

| | | |
|---|---|---|
| JP | B2-2734540 | 3/1998 |
| JP | A-2000-91144 | 3/2000 |
| JP | B2-3655870 | 6/2005 |
| JP | A-2007-303401 | 11/2007 |
| JP | A-2008-60188 | 3/2008 |
| JP | A-2008-60228 | 3/2008 |

* cited by examiner

*Primary Examiner* — Thomas Moulis
*Assistant Examiner* — Elizabeth Hadley
(74) *Attorney, Agent, or Firm* — Oliff PLC

(57) ABSTRACT

In an ignition coil for an internal combustion engine, a column section and a notched section are provided in a side wall section of a case section of the ignition coil. A ventilation opening is formed in an up/down direction in the column section. The ventilation opening communicates with a ventilation passage formed between a sealing rubber and the case section and is open in an upper end section. A cover surrounding the column section and covering the upper end section is provided in the side wall section. A sealing section sealing the notched section is provided in the cover. The ignition coil has a filler resin that fills a space within the case section being in continuous contact with the sealing section and the side wall section and fixing the cover to the side wall section.

17 Claims, 7 Drawing Sheets

IGNITION COIL FOR INTERNAL COMBUSTION ENGINES

CROSS-REFERENCE TO RELATED APPLICATION

This application is based on and claims the benefit of priority from earlier Japanese Patent Application No. 2011-049988 filed Mar. 8, 2011, the description of which is incorporated herein by reference.

BACKGROUND OF THE INVENTION

1. Field of the Invention

The present invention relates to an ignition coil for an internal combustion engine used to generate a spark within a combustion chamber of an engine, such as an internal combustion engine.

2. Description of the Related Art

In an internal combustion engine, an output portion of an ignition coil is disposed such as to be inserted into a plug hole provided in the engine. A spark plug is attached to an axial-direction tip end section of the output portion. The engine performs combustion as a result of ignition by the spark plug. Furthermore, in the internal combustion engine, to adjust the state of pressure within the plug hole depending on the expansion and contraction of air in accompaniment with temperature change, a ventilation passage is formed in the ignition coil.

As the engine cools from a heated state, the air within the plug hole cools. As a result, the pressure within the plug hole turns into negative pressure. If the ignition coil is exposed to water at this time, the water may infiltrate into the plug hole from the ventilation passage. Therefore, to prevent water infiltration, a sealing rubber or the like is disposed between the ignition coil and an opening section of the plug hole, and formation of the ventilation passage is modified.

As an ignition coil (ignition device) in which the ventilation passage has been modified, for example, an ignition coil disclosed in JP-A-2008-60188 is known. The ignition coil is configured such that a water collecting chamber and ventilation passage are formed in a side section of a connector case section disposed outside of the plug hole. The water collecting chamber is capable of collecting water that has infiltrated from outside of the connector case section. The ventilation passage communicates the water collecting chamber with the interior of the plug hole. Infiltration of water, such as cleaning water, into the plug hole can be prevented with certainty as a result of the water being collected in the water collecting chamber. The water collected in the water collecting chamber can be easily drained.

In addition, an ignition coil device for an internal combustion engine disclosed in JP-A-2007-303401 is configured such that a space is formed in an upper section within a connector case. A through-hole is formed downward from the space. The through-hole is communicated with the plug hole by a groove.

However, in JP-A-2008-60188, when water flows downward along a side wall section of the connector case section, the water may run around to a ventilation opening provided below the water collecting chamber and water infiltration may occur.

In addition, in JP-A-2007-303401, the space is formed by a cover that covers the connector case. Ventilation of the space is made possible by a gap formed between the cover and the connector case. Therefore, variations may occur in the formation of the gap. Although water infiltration may occur if the gap is increased, sufficient ventilation may not be possible if the gap is reduced.

Moreover, in JP-A-2008-60188 and JP-A-2007-303401, the cover is required to be separately fixed to the connector case section or the connector case by adhesion, welding, or the like. Therefore, production processes are numerous, and the inventions are insufficient for achieving reduction in production cost.

SUMMARY

Hence, it is desired to provide an ignition coil for an internal combustion engine enabling a cover to be fixed to a case section with simplified production processes and capable of effectively preventing infiltration of water into a plug hole.

An exemplary embodiment provides an ignition coil for an internal combustion engine, which includes: a coil output section that is disposed such as to be inserted into a plug hole of an internal combustion engine; a case section that is provided on an axial-direction upper end side of the coil output section and disposed outside of the plug hole; and a sealing rubber that is attached to a lower end section of the case section and seals an opening section of the plug hole.

A column section and a notched section are provided in a side wall section of the case section. The column section is formed by a portion of the side wall section being projected outward. The notched section is formed by a portion of the side wall section being cut from the upper end.

A ventilation opening is formed in an up/down direction in the column section. The ventilation opening communicates with a ventilation passage formed between the sealing rubber and the case section and is open in an upper end section. A cover surrounding the column section and covering an upper end section of the ventilation opening are provided in the side wall section. A sealing section sealing the notched section is provided in the cover. A filler resin filling a space within the case section is in continuous contact with the sealing section and the side wall section and fixes the cover to the side wall section.

The notched section is preferably provided on both sides of the column section. The sealing section is preferably provided continuously with an upper section and both sides of the cover, and preferably has a shape that continuously sandwiches edge sections surrounding the notched sections and a side wall upper end section positioned between the notched sections.

In this instance, the shapes of the notched sections and the sealing section are appropriate. When the space within the case section is filled with the filler resin, the sealing section can prevent the filler resin from leaking from the notched sections. The filler resin can fix the sealing section of the cover to the side wall section of the case section with certainty.

The sealing section is preferably formed such that an inner engaging wall and an outer engaging wall oppose each other. The inner engaging wall is disposed facing an inner surface of the side wall section and is in contact with the filler resin. The outer engaging wall is disposed facing an outer surface of the side wall section. A peak-shaped angled surface is preferably formed on a lower end surface in a portion of the outer engaging wall disposed facing the outer surface of the side wall upper end section positioned between the notched sections. A position opposing the upper end section of the ventilation opening of the column section serves as a peak section of the peak-shaped angled section. The peak-shaped angled surface is angled downward on both sides.

In this instance, the inner engaging wall and the outer engaging wall of the sealing section continuously sandwich the edge sections surrounding the notched sections and the side wall upper end section positioned between the notched sections. Leakage of filler resin can be more effectively prevented.

The side wall section provided with the column section is preferably positioned further towards the inner peripheral side than the outer peripheral position of the sealing rubber. The column section is preferably formed facing upwards from a base section formed in a position further towards the outer peripheral side than the side wall section provided with the column section and above the sealing rubber. A projecting section that projects laterally is preferably provided in the base section. The cover is preferably formed such that a lower end section in which an opening section is formed is disposed in the periphery of the projecting section. An opening hole is preferably formed on both sides of the column section in the projecting section or between the projecting section and the cover. A case wall section is preferably erected in the up/down direction in the side wall section on both sides of the column section. The case wall section is connected to the side wall section and the projecting section. Cover wall sections respectively disposed between the column section and the case wall sections are preferably erected in the up/down direction in the upper portion of the inner surface of the cover.

The side wall section provided with the column section is preferably positioned further towards the inner peripheral side than an outer peripheral position of the sealing rubber. The column section is preferably formed facing upwards from a base section formed in a position further towards the outer peripheral side than the side wall section provided with the column section and above the sealing rubber. A projecting section that projects laterally is preferably provided in the base section. The cover is preferably formed such that a lower end section in which an opening section is formed is disposed in the periphery of the projecting section. An opening hole is preferably formed on both sides of the column section in the projecting section or between the projecting section and the cover. A plurality of barriers are preferably erected in the up/down direction at a predetermined interval below the projecting section. The barriers divide an opening section formed by the cover and the base section.

An angled chamfer section is preferably formed in at least one of an inner corner section and an outer corner section of a side wall upper end section positioned between the notched sections. A position above the upper end section of the ventilation opening of the column section serves as a starting point of the angled chamfer section. The angled chamfer section gradually widens towards both sides.

DETAILED DESCRIPTION OF THE PREFERRED EMBODIMENTS

A preferred embodiment of an ignition coil for an internal combustion engine of the present invention, described above, will be described with reference to the drawings.

Figure 1:
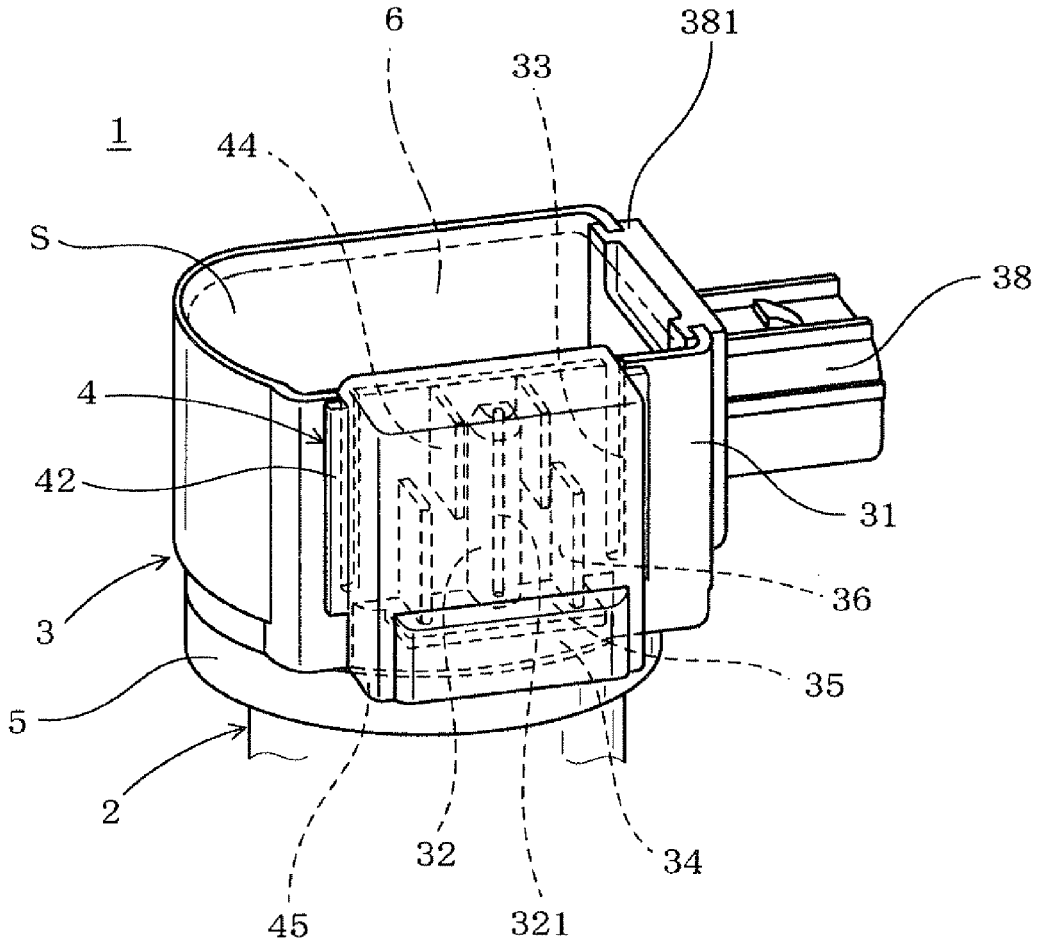
FIG. 1 is a perspective view of a case section of an ignition coil in an embodiment.
Figure 5:
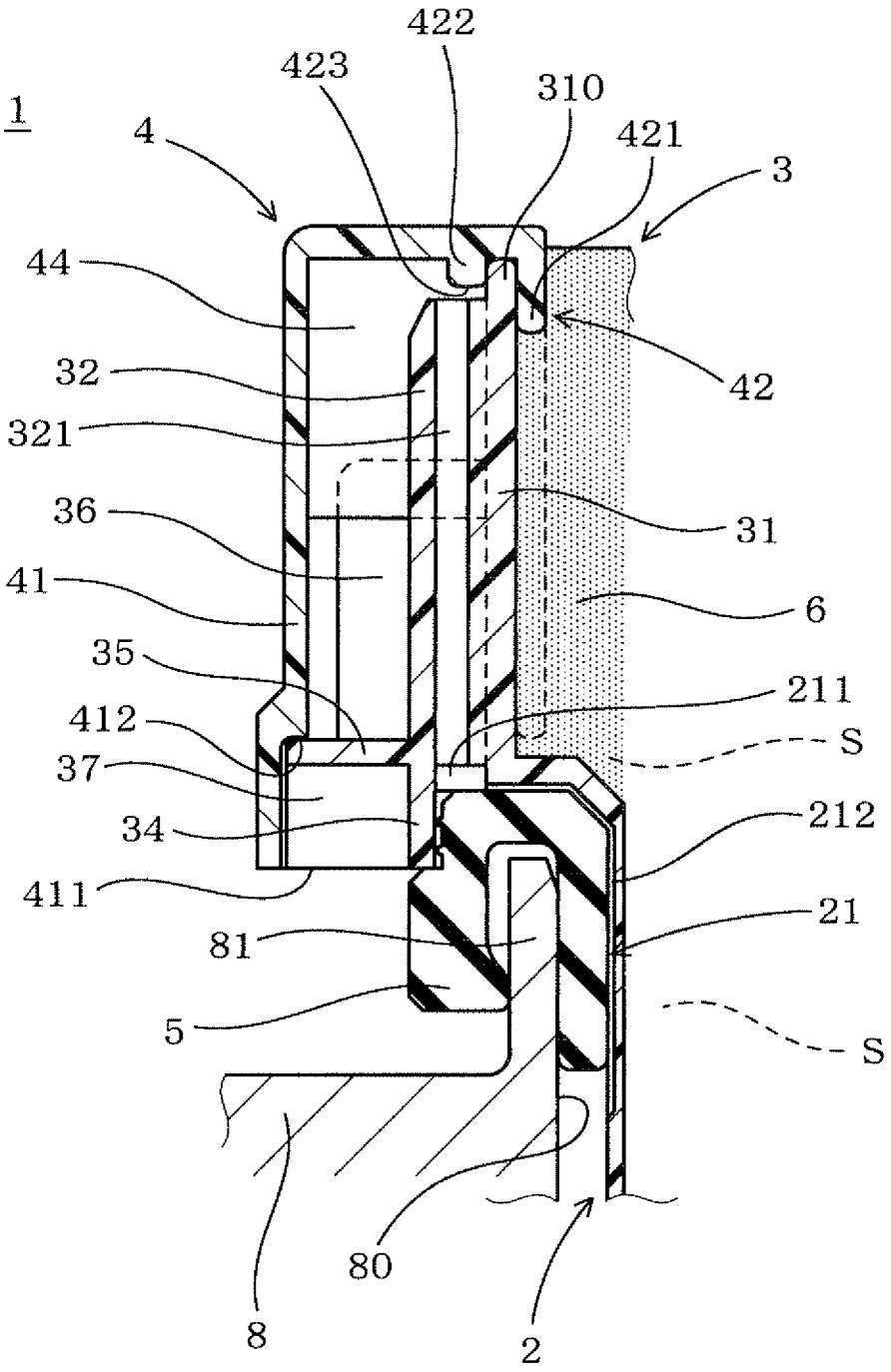
FIG. 5 is a cross-sectional view of the periphery of the cover attached to the case section in the embodiment, taken along line V-V in FIG. 4.

As shown in FIG. 1 and FIG. 5, an ignition coil 1 for an internal combustion engine (also referred to simply as an "ignition coil 1") of the present embodiment includes a coil output section 2, a case section 3, and a sealing rubber 5. The coil output section 2 is disposed such as to be inserted into a plug hole 80 of an internal combustion engine (engine). The case section 3 is provided on an axial-direction upper end side of the coil output section 2 and disposed outside of the plug hole 80. The sealing rubber 5 is attached to a lower end section of the case section 3 and seals an opening section of the plug hole 80.

A column section 32 and a notched section 33 are provided in a side wall section 31 of the case section 3. The column section 32 is formed by a portion of the side wall section 31 being projected outward. The notched section 33 is formed by a portion of the side wall section 31 being cut from the upper end.

A ventilation opening 321 is formed in the up/down direction in the column section 32. The ventilation opening 321 communicates with a ventilation passage 21 and is open in the upper end section. The ventilation passage 21 is formed between the sealing rubber 5 and the case section 3. A cover 4 that surrounds the column section 32 and covers the upper end section of the ventilation opening 321 is provided in the side wall section 31 of the case section 3. A sealing section 42 that seals the notched section 33 is formed in the cover 4. The ignition coil 1 is configured by a filler resin 6 that fills a space S within the case section 3 being in continuous contact with the sealing section 42 and the side wall section 31, thereby fixing the cover 4 to the side wall section 31.

The ignition coil 1 for an internal combustion engine of the present embodiment will hereinafter be described in detail with reference to FIG. 1 to FIG. 8.

In the ignition coil 1, a primary coil and a secondary coil, a soft-magnetic center core, and a soft-magnetic outer core are disposed within a case configuring the coil output section 2 (not shown). The primary coil and the secondary coil are disposed such as to be layered concentrically in the inner and outer peripheries. The center core is disposed on the inner peripheral side of the primary coil and the secondary coil. The outer core is disposed on the outer peripheral side of the primary coil and the secondary coil. The primary coil, the secondary coil, the center core, and the outer core may be disposed within a case configuring the case section 3.

As shown in FIG. 1, a connector section 38 and an attachment flange section are formed in the case section 3 such as to project laterally. The connector section 38 is used to electrically connect the ignition coil 1 with an external electronic control unit (ECU) or the like. The attachment flange section is used to attach the ignition coil 1. An igniter including a switching circuit and the like is disposed in a portion of the connector section 38 that is disposed within the case section 3. The switching circuit sends and blocks current to the primary coil.

As shown in FIG. 5, the ignition coil 1 is used such that the coil output section 2 is attached to a spark plug attached within the plug hole 80 of an engine 8. The case configuring the coil output section 2 and the case configuring the case section 3 in the present embodiment are integrally molded using thermoplastic resin. The sealing rubber 5 is attached to an opening upper end section 81 of the plug hole 80 in the engine 8. The sealing rubber 5 seals a gap in the opening upper end section 81 formed with the ignition coil 1 (the coil output section 2 and the case section 3).

Figure 2:
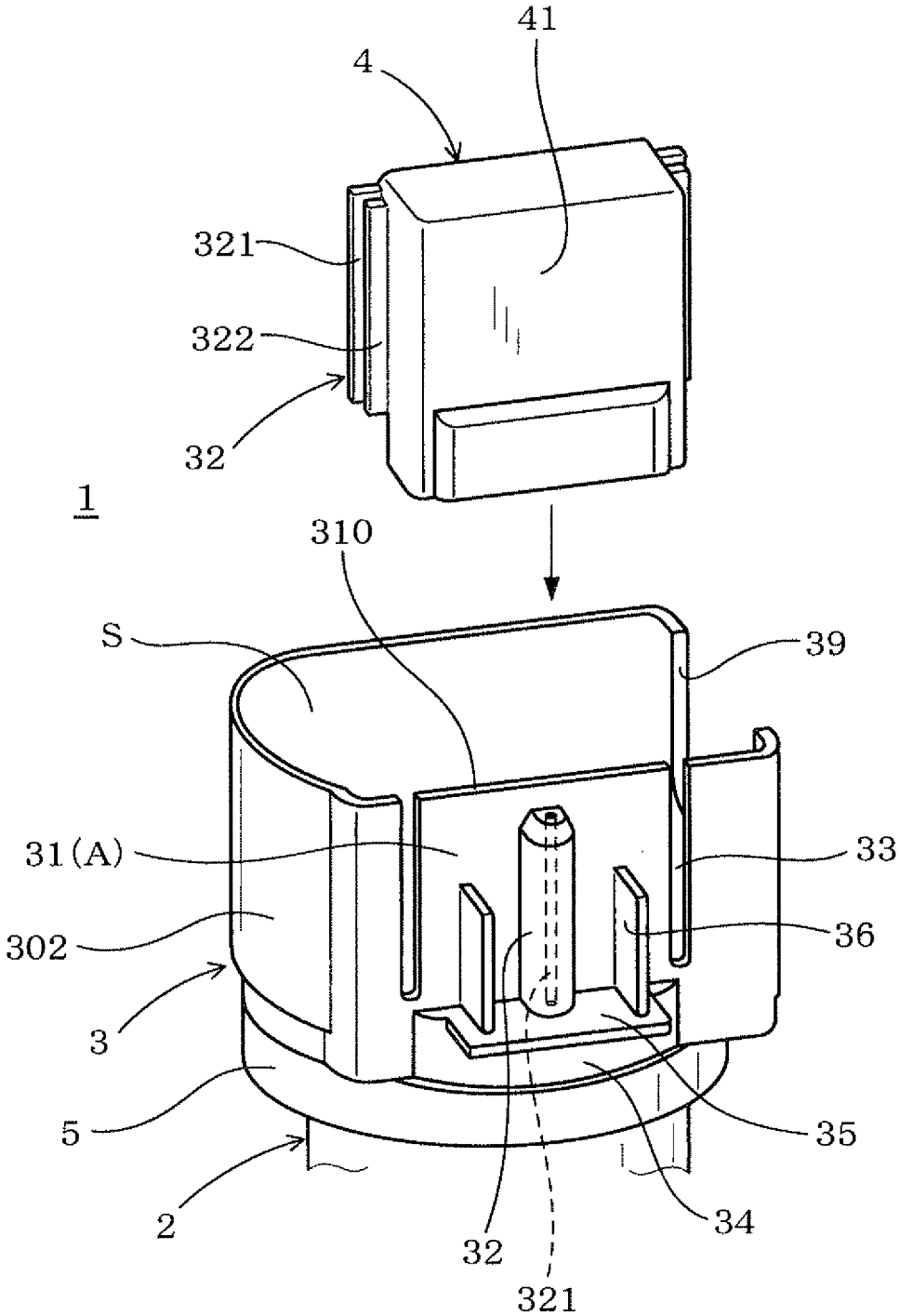
FIG. 2 is a perspective view of the case section before a cover is attached thereto and the cover in the embodiment.

As shown in FIG. 2 and FIG. 5, a column section formation side wall section 31A provided with the column section 32 is positioned further towards the inner peripheral side than the outer peripheral side of the sealing rubber 5. The column section 32 is formed facing upwards from a base section 34 that is formed in a position further towards the outer peripheral side than the column section formation side wall section 31A and above the sealing rubber 5. The column section 32 is formed as a circular column portion having a substantially semicircular horizontal cross-sectional shape, serving as a portion of an outer surface 302 of the side wall section 31 of the case section 3 that projects in a radial direction of the ignition coil 1.

As shown in FIG. 5, a portion of the column section formation side wall section 31A in the circumferential direction positioned above the ring-shaped sealing rubber 5 is formed as a planar side wall portion that recesses further inward than the outer peripheral contour of the sealing rubber 5. The base section 34 is formed as a portion positioned on the inner peripheral side of the outer peripheral contour of the sealing rubber 5 and the outer peripheral side of the column section formation side wall section 31A.

A projecting section 35 that projects laterally with plate surfaces facing the up/down direction is provided in the base section 34. The cover 4 is attached to the notched section 33 in the case section 3 such that the lower end section of the cover 4 in which an opening portion 411 is formed is disposed in the periphery of the projecting section 35.

The notched section 33 is provided in the side wall section 31 of the case section 3 on both sides of the column section 32. The notched sections 33 are cut downward from a side wall upper end section 310 in parallel with each other. The notched sections 33 are formed in parallel with each other in the side wall section 31 as slits elongated in the up/down direction.

Figure 3:
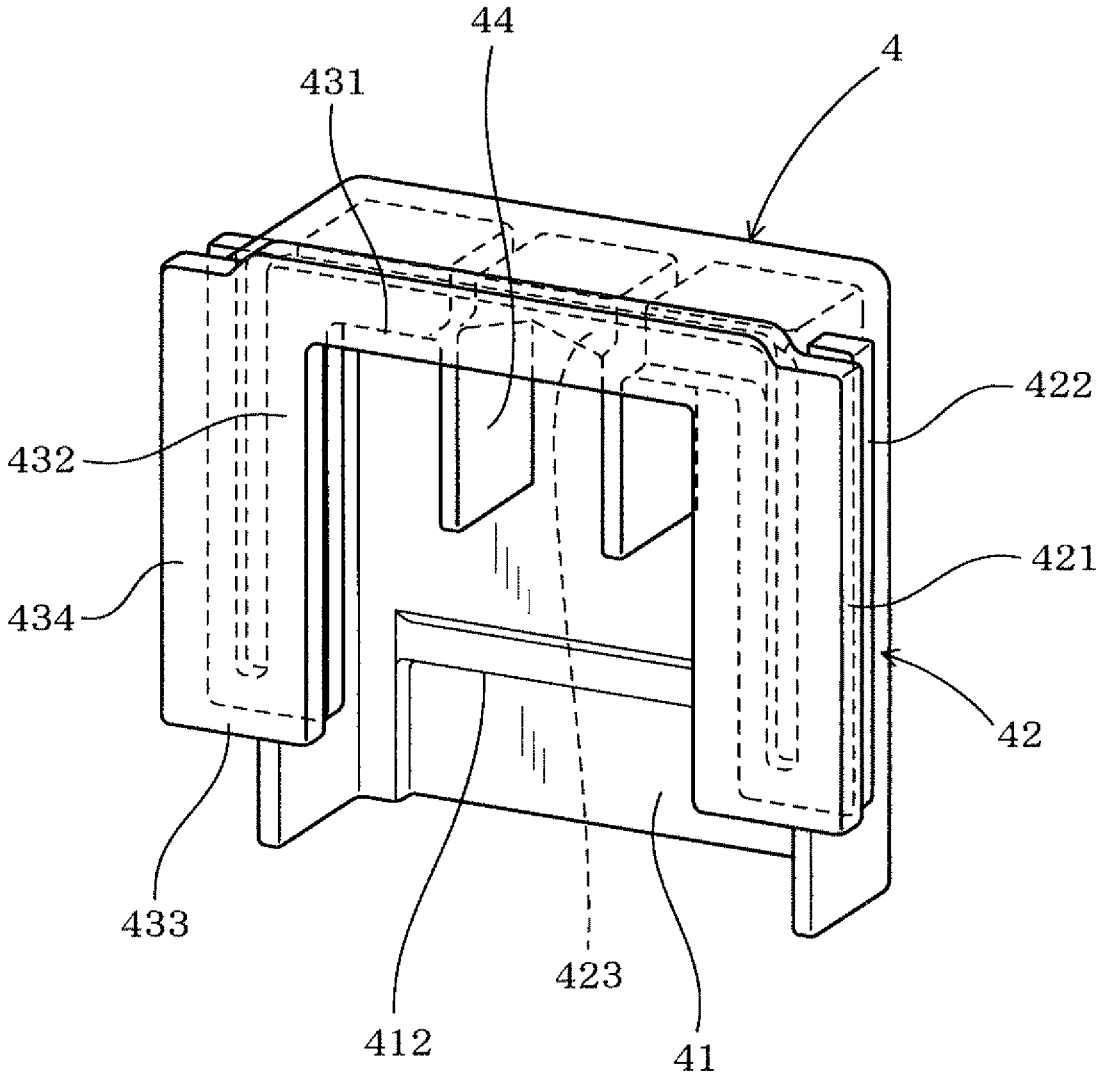
FIG. 3 is a perspective view of the cover in the embodiment, viewed from within.

As shown in FIG. 3 and FIG. 5, the lower section of a cover body section 41 of the cover 4 opposing the column section formation side wall section 31A spreads outward by a stepped section 412. When the cover 4 is attached to the case section 3, the stepped section 412 of the cover 4 comes into contact with the projecting section 35. Infiltration of water into the cover 4 from this area is prevented.

Figure 6:
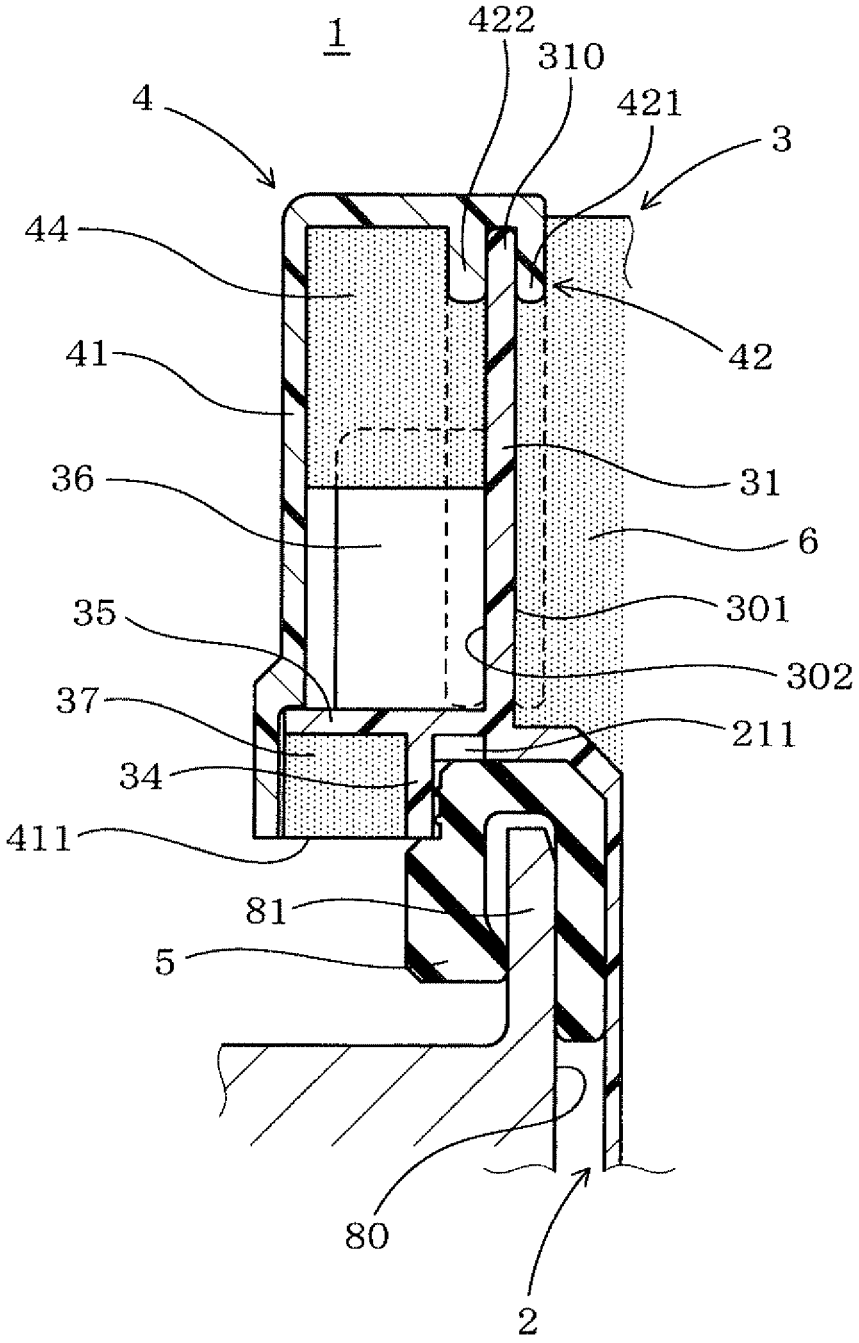
FIG. 6 is a cross-sectional view of the periphery of the cover attached to the case section according to the embodiment, taken along line VI-VI in FIG. 4.

As shown in FIG. 3 and FIG. 6, the sealing section 42 is provided continuously with the upper section and both sides of the cover 4 (cover body section 41). The sealing section 42 has a shape that continuously sandwiches the edge sections surrounding the notched sections 33 and the side wall upper end section 310 positioned between the notched sections 33. More specifically, the sealing section 42 is formed such that an inner engaging wall 421 and an outer engaging wall 422 oppose each other. The inner engaging wall 421 is disposed facing the inner surface 301 of the side wall section 31 and is in contact with the filler resin 6. The outer engaging wall 422 is disposed facing the outer surface 302 of the side wall section 31.

The inner engaging wall 421 and the outer engaging wall 422 are each configured by an upper wall portion 431, a pair of side inner peripheral wall portions 432, a pair of lower wall portions 433, and a pair of side outer peripheral wall portions 434. The upper wall portion 431 is disposed below the side wall upper end section 310. The pair of side inner peripheral wall portions 432 are connected to both end sections of the upper wall portion 431 and disposed on the inner peripheral side of the pair of notched sections 33. The pair of lower wall portions 433 are connected to the lower end sections of the pair of side inner peripheral wall portions 432 and disposed below the notched sections 33. The pair of side outer peripheral wall portions 434 are connected to the outer sections of the pair of lower wall portions 433 and disposed on the outer peripheral side of the pair of notched sections 33.

The inner engaging wall 421 and the outer engaging wall 422 are formed such that respective overall wall portions 431, 432, 433, and 434 oppose one another. The inner engaging wall 421 and the outer engaging wall 422 are formed continuously in the overall periphery of the pair of notched sections 33 and the side wall upper end section 310.

The upper section of the cover 4 seals the area between the upper wall portion 431 of the inner engaging wall 421 and the upper wall portion 431 of the outer engaging wall 422. The area between the upper end section of the side outer peripheral wall portion 434 of the inner engaging wall 421 and the upper end section of the side outer peripheral wall portion 434 of the outer engaging wall 422 may be opened upwards as in the present embodiment or may be sealed.

The edge sections surrounding the notched sections 33 and the side wall upper end section 310 positioned between the notched sections 33 can be continuously sandwiched by the inner engaging wall 421 and the outer engaging wall 422. Therefore, leakage of the filler resin 6 can be more effectively prevented. When the sealing section 42 of the cover 4 is engaged with the notched sections 33 of the side wall section 31, as shown in FIG. 6, the inner engaging wall 421 comes into close contact with the inner surface 301 of the side wall section 31. At the inner engaging wall 421, the filler resin 6 can be prevented from leaking from the notched sections 33 outside of the case section 3.

As shown in FIG. 1 and FIG. 2, the connector section 38 is attached to a separate notched section 39 formed in the side wall section 31 of the case section 3 by a sealing section 381 provided in the connector section 38. The connector section 38 is fixed to the side wall section 31 by the filler resin 6. The sealing section 381 has a sandwich-structure similar to that of the sealing section 42 composed of the inner engaging wall 421 and the outer engaging wall 422.

In other words, the sealing section 42 of the cover 4 in the present embodiment is formed by the structure of the sealing section 381 of the connector section 38 being modified.

Figure 4:
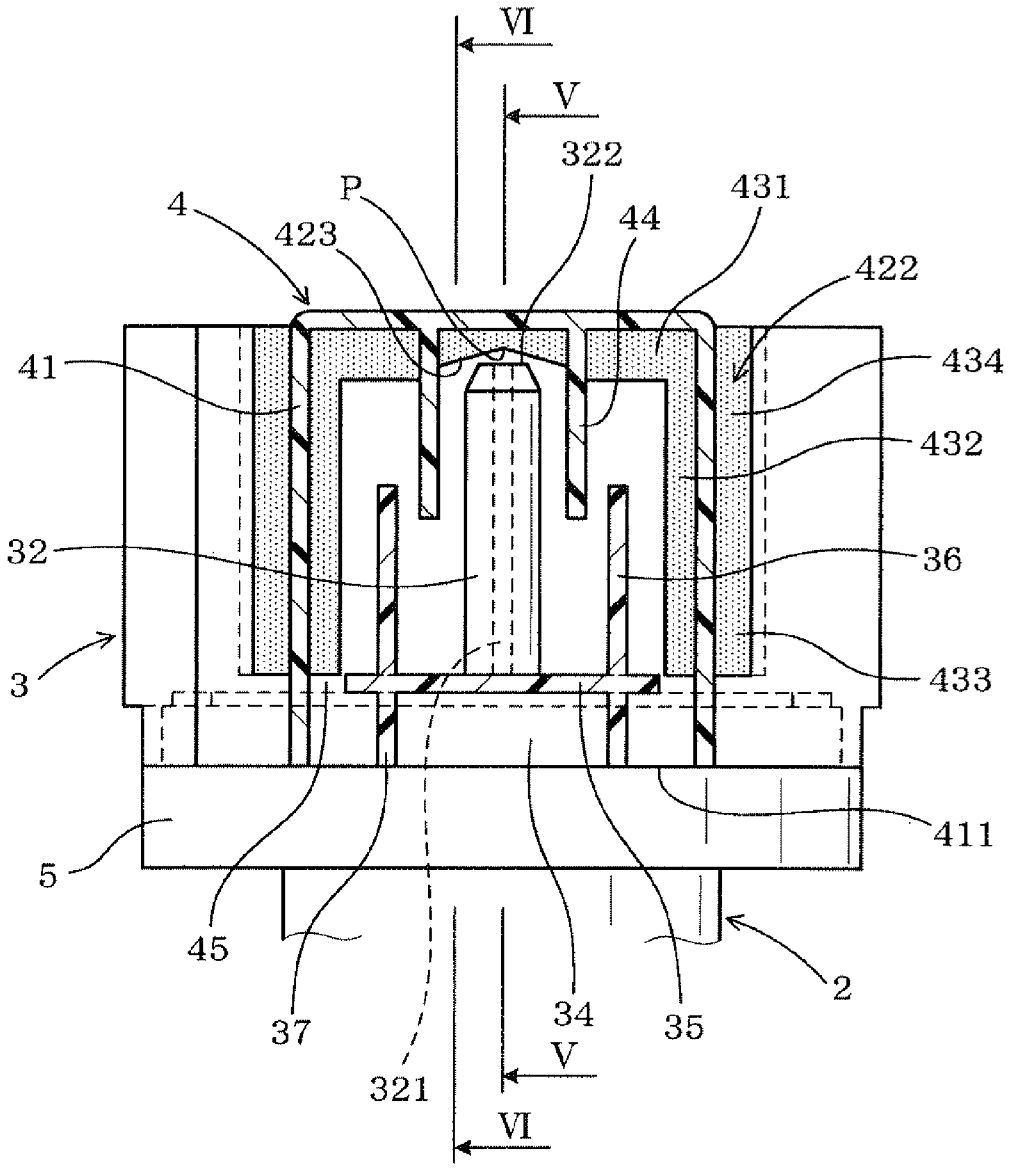
FIG. 4 is a cross-sectional view of the periphery of the cover attached to the case section in the embodiment.

As shown in FIG. 4, in a state in which the sealing section 42 of the cover 4 is attached to the notched sections 33 of the side wall section 31, an opening hole 45 is formed on both sides of the column section 32 between the outer end of the projecting section 35 and the inner surface of the side section of the cover 4.

In the column section formation side wall section 31A, a case wall section 36 is erected in the up/down direction on both the left side and the right side of the column section 32. The case wall section 36 is connected to the side wall section 31 and the projecting section 35. In addition, in the upper portion of the inner surface of the cover 4, a cover wall section 44 is erected in the up/down direction on both the left side and the right side of the column section 32. Each cover wall section 44 is disposed between the column section 32 and the case wall section 36.

The upper end section of the case wall section 36 and the lower end section of the cover wall section 44 overlap in the up/down direction, and portions thereof oppose each other in the left/right direction.

Even when water infiltrates into the cover 4 from the opening holes 45 formed between the projecting section 35 and the cover 4, the water can be made unlikely to reach the upper end section of the ventilation opening 321 as a result of the case wall sections 36 erected in the side wall section 31 and the cover wall sections 44 erected in the upper portion of the inner surface of the cover 4.

In addition, because the opening holes 45 are formed on both sides of the column section 32, when water infiltrates into the cover 4 from either opening hole 45, water that has already infiltrated into the cover 4 can be drained from the other opening hole 45.

Figure 7:
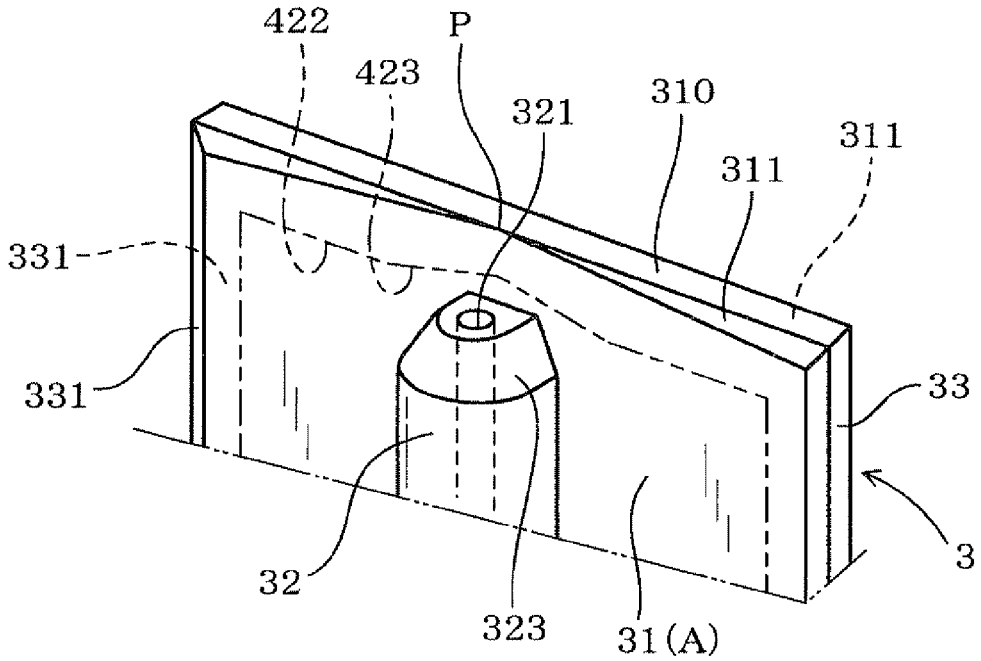
FIG. 7 is a perspective view of a side wall section provided with a column section in the embodiment.

Furthermore, as shown in FIG. 7, an angled chamfer section 311 is formed in the inner corner section and the outer corner section of the side wall upper end section 310 positioned between the notched sections 33. A position above the upper end section of the ventilation opening 321 of the column section 32 serves as a starting point P of the angled chamfer section 311. The angled chamfer section 311 gradually widens towards both sides. A chamfer section 331 is also formed in the overall inner corner section of the notched section 33 facing the inner engaging wall 421 and in the overall outer corner section of the notched section 33 facing the outer engaging wall 422.

In this way, even should the filler resin 6 leak into the gap between the side wall upper end section 310 and the sealing section 42, the leaked filler material 6 can be led outward in the left/right direction of at least one angled chamfer section 311 from the starting point P in the position above the upper end section of the ventilation opening 321. Therefore, the filler resin 6 can be prevented with certainty from entering and sealing the ventilation opening 321.

Figure 8:
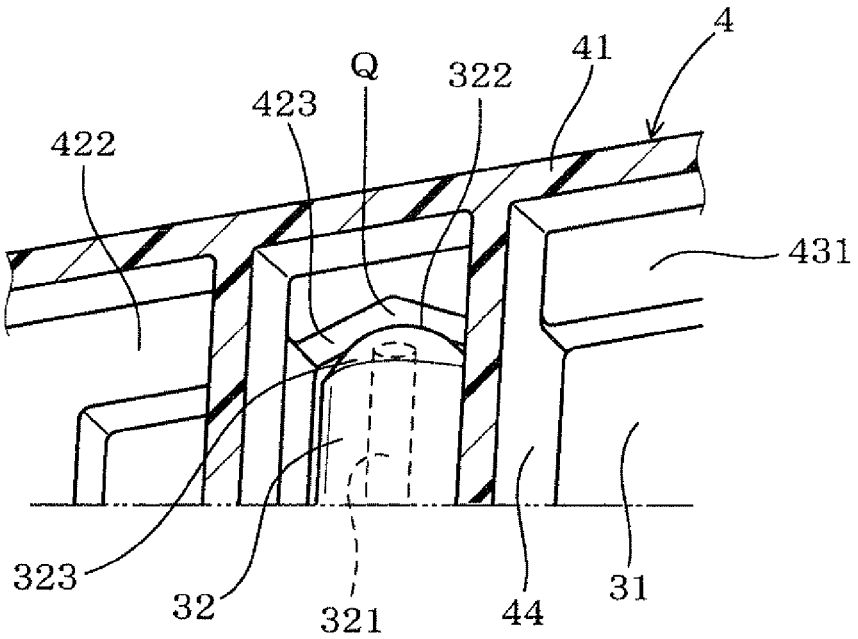
FIG. 8 is a cross-sectional explanatory diagram of the cover in the periphery of the column section in the embodiment.

As shown in FIG. 8, a peak-shaped angled surface 423 is formed on the lower end surface in a portion of the outer engaging wall 422 positioned facing the outer surface 302 of the side wall upper end section 310 positioned between the notched sections 33. A position opposing the upper end section of the ventilation opening 321 of the column section 32 serves as a peak section Q of the peak-shaped angled surface 423. The peak-shaped angled surface 423 is angled downwards on the left side and the right side. The peak-shaped angled surface 423 is formed on the lower end surface of the upper wall portion 431 of the outer engaging wall 422 positioned between the pair of cover wall sections 44 in the cover 4.

A chamfer section 323 is formed in the corner section in the upper end section of the column section 32, making infiltration of water into the ventilation opening 321 of the column section 32 difficult. The upper end portion of the column section 32 in which the chamfer section 323 is formed is disposed in a space formed below the peak-shaped angled surface 423, making infiltration of water into the ventilation opening 321 difficult.

In addition, because the peak section Q of the peak-shaped angled surface 423 opposes the upper end section of the ventilation opening 321, even should the filler resin 6 leak into the gap between the side wall upper end section 310 and the sealing section 42, the leaked filler resin 6 can be led outward in the left/right direction of at least one angled surface 423 from the peak section Q. Therefore, the filler resin 6 can be prevented with certainty from entering and sealing the ventilation opening 321.

In addition, as shown in FIG. 4 and FIG. 6, a plurality of barriers 37 are erected in the up/down direction at a predetermined interval below the projecting section 35. The barriers 37 divide an opening portion 411 formed by the cover 4 and the base section 34. The barriers 37 are formed in a pair on the left side and the right side of the position in which the column section 32 is formed, such as to partition the opening section 411 into a center portion and both side portions. The barriers 37 in the present embodiment are formed in a pair in an area positioned below the pair of case wall sections 36. Water striking the lower opening section 411 of the cover 4 below the projecting section 35 comes into contact with the barriers 37, thereby making infiltration of water into the opening hole 45 difficult.

As shown in FIG. 5, the ventilation passage 21 is formed by a ventilation space 211 and a ventilation groove 212. The ventilation space 211 is provided inside the base section 34. The ventilation groove 212 is formed on the inner peripheral side of the sealing rubber 5.

The position in which the ventilation groove 212 is formed is shifted in the circumferential direction relative to the position in which the ventilation opening 321 communicates with the ventilation space 211. In FIG. 5, the circumferential direction position in which the ventilation opening 321 is formed and the circumferential direction position in which the ventilation groove 212 is formed are aligned to simplify the drawing. The ventilation groove 212 is formed continuously with the axial direction of the coil output section 2 and the radial direction of the case section 3. In addition, the ventilation groove 212 can be formed in the sealing rubber 5.

The filler resin 6 fills the interior of the space S of the ignition coil 1 surrounded by the coil output section 2 and the case section 3. The filler resin 6 in the present embodiment is an epoxy resin serving as a thermoset resin. After each constituent component of the ignition coil 1 is assembled, the interior of the space S in the ignition coil 1 is placed in a vacuum state. A liquid epoxy resin fills the space S that is in a vacuum state and is subsequently hardened, thereby forming the filler resin 6 in the ignition coil 1.

In the ignition coil 1 for an internal combustion engine in the present embodiment, the method by which the cover 4 covering the column section 32 in which the ventilation opening 321 is formed in a penetrating manner is fixed to the case section 3 is modified.

Specifically, the notched sections 33 are provided in the side wall section 31 of the case section 3. The sealing section 42 that seals the notched sections 33 is provided in the cover section 4. The filler resin 6 filing the space S within the case section 3 comes into continuous contact with the inner engaging wall 421 of the sealing section 42 and the side wall section 31. As a result, the cover section 4 is fixed to the side wall section 31 by the filler resin 6. Therefore, an adhesion process, a welding process, or the like is not required to be separately performed to fix the cover 4 to the side wall section 31 in the case section 3. Production cost can be reduced.

In addition, in the ignition coil 1 of the present embodiment, communication between atmospheric air and the interior of the plug hole 80 is achieved by the space within the cover 4, the ventilation opening 321, and the ventilation passage 21. The air within the plug hole 80 can flow from the ventilation passage 21 to the ventilation opening 321, from the ventilation opening 321 into the space within the cover 4, and be discharged outside of the ignition coil 1 from the opening portion 411 of the cover 4. As a result, ventilation can be achieved between the interior of the plug hole 80 and the outside.

In addition, when combustion is performed in the engine 8 using the ignition coil 1 and the engine 8 cools from a heated state, negative pressure is generated within the plug hole 80. At this time, even when the case section 3 of the ignition coil 1 is exposed to water, the upper end section of the ventilation opening 321 of the column section 32 is covered by the cover 4. Therefore, the water can be kept from infiltrating into the plug hole 80 from the upper end section of the ventilation opening 321.

Thus, in the ignition coil 1 for an internal combustion engine of the present embodiment, the cover 4 can be fixed to the case 3 with simplified production processes, and infiltration of water into the plug hole 80 can be effectively prevented.

The present invention may be embodied in several other forms without departing from the spirit thereof. The embodiment described so far are therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. An ignition coil for an internal combustion engine including a coil output section that is disposed such as to be inserted into a plug hole of an internal combustion engine, a case section that is provided on an axial-direction upper end side of the coil output section and disposed outside of the plug hole, and a sealing rubber that is attached to a lower end section of the case section and seals an opening section of the plug hole, wherein:

a column section and a notched section are provided in a side wall section of the case section, the column section being formed by a portion of the side wall section being projected outward and the notched section being formed by a portion of the side wall section being cut from the upper end;

a ventilation opening is formed in an up/down direction in the column section, the ventilation opening communicating with a ventilation passage formed between the sealing rubber and the case section and being open in an upper end section;

a cover surrounding the column section and covering an upper end section of the ventilation opening is provided in the side wall section, and a sealing section sealing the notched section is provided in the cover; and a filler resin filling a space within the case section is in continuous contact with the sealing section and the side wall section and fixes the cover to the side wall section.

2. The ignition coil for an internal combustion engine according to claim 1, wherein:

the notched section is provided on both sides of the column section;

the sealing section is provided continuously with an upper section and both sides of the cover, and has a shape that continuously sandwiches edge sections surrounding the notched sections and a side wall upper end section positioned between the notched sections.

3. The ignition coil for an internal combustion engine according to claim 2, wherein:

the sealing section is formed such that an inner engaging wall and an outer engaging wall oppose each other, the inner engaging wall being disposed facing an inner surface of the side wall section and in contact with the filler resin, and the outer engaging wall being disposed facing an outer surface of the side wall section;

a peak-shaped angled surface is formed on a lower end surface in a portion of the outer engaging wall disposed facing the outer surface of the side wall upper end section positioned between the notched sections, a position opposing the upper end section of the ventilation opening of the column section serving as a peak section of the peak-shaped angled section, and the peak-shaped angled surface being angled downward on both sides.

4. The ignition coil for an internal combustion engine according to claim 3, wherein:

the side wall section provided with the column section is positioned further towards the inner peripheral side than the outer peripheral position of the sealing rubber;

the column section is formed facing upwards from a base section formed in a position further towards the outer peripheral side than the side wall section provided with the column section and above the sealing rubber, and a projecting section that projects laterally is provided in the base section;

the cover is formed such that a lower end section in which an opening section is formed is disposed in the periphery of the projecting section;

an opening hole is formed on both sides of the column section in the projecting section or between the projecting section and the cover;

a case wall section is erected in the up/down direction in the side wall section on both sides of the column section, the case wall section being connected to the side wall section and the projecting section;

cover wall sections respectively disposed between the column section and the case wall sections are erected in the up/down direction in the upper portion of the inner surface of the cover.

5. The ignition coil for an internal combustion engine according to claim 3, wherein the side wall section provided with the column section is positioned further towards the inner peripheral side than the outer peripheral position of the sealing rubber;

the column section is formed facing upwards from a base section formed in a position further towards the outer peripheral side than the side wall section provided with the column section and above the sealing rubber, and a projecting section that projects laterally is provided in the base section;

the cover is formed such that a lower end section in which an opening section is formed is disposed in the periphery of the projecting section;

an opening hole is formed on both sides of the column section in the projecting section or between the projecting section and the cover;

a plurality of barriers are erected in the up/down direction at a predetermined interval below the projecting section, the barriers dividing an opening section formed by the cover and the base section.

6. The ignition coil for an internal combustion engine according to claim 4, wherein:

an angled chamfer section is formed in at least one of an inner corner section and an outer corner section of a side wall upper end section positioned between the notched sections, a position above the upper end section of the ventilation opening of the column section serving as a starting point of the angled chamfer section, and the angled chamfer section gradually widening towards both sides.

7. The ignition coil for an internal combustion engine according to claim 5, wherein:

an angled chamfer section is formed in at least one of an inner corner section and an outer corner section of a side wall upper end section positioned between the notched sections, a position above the upper end section of the ventilation opening of the column section serving as a starting point of the angled chamfer section, the angled chamfer section gradually widening towards both sides.

8. The ignition coil for an internal combustion engine according to claim 1, wherein:

the sealing section is formed such that an inner engaging wall and an outer engaging wall oppose each other, the inner engaging wall being disposed facing an inner surface of the side wall section and in contact with the filler resin, and the outer engaging wall being disposed facing an outer surface of the side wall section;

a peak-shaped angled surface is formed on a lower end surface in a portion of the outer engaging wall disposed facing the outer surface of the side wall upper end section positioned between the notched sections, a position opposing the upper end section of the ventilation opening of the column section serving as a peak section of the peak-shaped angled section, and the peak-shaped angled surface being angled downward on both sides.

9. The ignition coil for an internal combustion engine according to claim 8, wherein:

the side wall section provided with the column section is positioned further towards the inner peripheral side than the outer peripheral position of the sealing rubber;

the column section is formed facing upwards from a base section formed in a position further towards the outer peripheral side than the side wall section provided with the column section and above the sealing rubber, and a projecting section that projects laterally is provided in the base section;

the cover is formed such that a lower end section in which an opening section is formed is disposed in the periphery of the projecting section;

an opening hole is formed on both sides of the column section in the projecting section or between the projecting section and the cover;

a case wall section is erected in the up/down direction in the side wall section on both sides of the column section, the case wall section being connected to the side wall section and the projecting section;

cover wall sections respectively disposed between the column section and the case wall sections are erected in the up/down direction in the upper portion of the inner surface of the cover.

10. The ignition coil for an internal combustion engine according to claim 9, wherein:

an angled chamfer section is formed in at least one of an inner corner section and an outer corner section of a side wall upper end section positioned between the notched sections, a position above the upper end section of the ventilation opening of the column section serving as a starting point of the angled chamfer section, and the angled chamfer section gradually widening towards both sides.

11. The ignition coil for an internal combustion engine according to claim 9, wherein the side wall section provided with the column section is positioned further towards the inner peripheral side than the outer peripheral position of the sealing rubber;

the column section is formed facing upwards from a base section formed in a position further towards the outer peripheral side than the side wall section provided with the column section and above the sealing rubber, and a projecting section that projects laterally is provided in the base section;

the cover is formed such that a lower end section in which an opening section is formed is disposed in the periphery of the projecting section;

an opening hole is formed on both sides of the column section in the projecting section or between the projecting section and the cover;

a plurality of barriers are erected in the up/down direction at a predetermined interval below the projecting section, the barriers dividing an opening section formed by the cover and the base section.

12. The ignition coil for an internal combustion engine according to claim 11, wherein:

an angled chamfer section is formed in at least one of an inner corner section and an outer corner section of a side wall upper end section positioned between the notched sections, a position above the upper end section of the ventilation opening of the column section serving as a starting point of the angled chamfer section, and the angled chamfer section gradually widening towards both sides.

13. The ignition coil for an internal combustion engine according to claim 1, wherein:

the side wall section provided with the column section is positioned further towards the inner peripheral side than the outer peripheral position of the sealing rubber;

the column section is formed facing upwards from a base section formed in a position further towards the outer peripheral side than the side wall section provided with the column section and above the sealing rubber, and a projecting section that projects laterally is provided in the base section;

the cover is formed such that a lower end section in which an opening section is formed is disposed in the periphery of the projecting section;

an opening hole is formed on both sides of the column section in the projecting section or between the projecting section and the cover;

a case wall section is erected in the up/down direction in the side wall section on both sides of the column section, the case wall section being connected to the side wall section and the projecting section;

cover wall sections respectively disposed between the column section and the case wall sections are erected in the up/down direction in the upper portion of the inner surface of the cover.

14. The ignition coil for an internal combustion engine according to claim 13, wherein:

an angled chamfer section is formed in at least one of an inner corner section and an outer corner section of a side wall upper end section positioned between the notched sections, a position above the upper end section of the ventilation opening of the column section serving as a starting point of the angled chamfer section, the angled chamfer section gradually widening towards both sides.

15. The ignition coil for an internal combustion engine according to claim 1, wherein the side wall section provided with the column section is positioned further towards the inner peripheral side than the outer peripheral position of the sealing rubber;

the column section is formed facing upwards from a base section formed in a position further towards the outer peripheral side than the side wall section provided with the column section and above the sealing rubber, and a projecting section that projects laterally is provided in the base section;

the cover is formed such that a lower end section in which an opening section is formed is disposed in the periphery of the projecting section;

an opening hole is formed on both sides of the column section in the projecting section or between the projecting section and the cover;

a plurality of barriers are erected in the up/down direction at a predetermined interval below the projecting section, the barriers dividing an opening section formed by the cover and the base section.

16. The ignition coil for an internal combustion engine according to claim 15, wherein:

an angled chamfer section is formed in at least one of an inner corner section and an outer corner section of a side wall upper end section positioned between the notched sections, a position above the upper end section of the ventilation opening of the column section serving as a starting point of the angled chamfer section, the angled chamfer section gradually widening towards both sides.

17. The ignition coil for an internal combustion engine according to claim 1, wherein:

an angled chamfer section is formed in at least one of an inner corner section and an outer corner section of a side wall upper end section positioned between the notched sections, a position above the upper end section of the ventilation opening of the column section serving as a starting point of the angled chamfer section, and the angled chamfer section gradually widening towards both sides.

* * * * *